United States Patent [19]

Swift

[11] Patent Number: 4,715,840

[45] Date of Patent: Dec. 29, 1987

[54] EXPANSIBLE OBJECT

[76] Inventor: Jeffery G. Swift, 5418 Nicole, Milford, Mich. 48082

[21] Appl. No.: 892,031

[22] Filed: Aug. 1, 1986

[51] Int. Cl.[4] ..... A63H 3/00

[52] U.S. Cl. ..... 446/74; 446/73; 446/369

[58] Field of Search ..... 446/74, 73, 321, 369, 446/485

[56] References Cited

U.S. PATENT DOCUMENTS

| | | | |
|---|---|---|---|
| 1,638,594 | 8/1927 | Myers | 446/74 |
| 1,756,048 | 4/1930 | Williams | 446/74 |
| 2,591,379 | 4/1952 | Schradermeier | 446/74 |
| 2,647,222 | 7/1953 | Nieset | 446/369 |
| 2,748,256 | 5/1956 | Moran | 446/485 |
| 2,995,865 | 8/1961 | Kiscadden | 446/73 |
| 3,520,078 | 7/1970 | Klamer | 446/73 |
| 4,336,665 | 6/1982 | Moreau | 446/321 |
| 4,413,442 | 11/1983 | McSweeney | 446/73 |
| 4,543,669 | 10/1985 | Katz | 446/73 |
| 4,563,159 | 1/1986 | Hills et al. | 446/369 |

FOREIGN PATENT DOCUMENTS

| | | | |
|---|---|---|---|
| 12989 | of 1911 | United Kingdom | 446/73 |
| 2131310 | 6/1984 | United Kingdom | 446/74 |

*Primary Examiner*—Victor N. Sakran

*Attorney, Agent, or Firm*—Arnold S. Weintraub

[57] ABSTRACT

An expansible object includes a body simulating in shape an animate object, such as an insect. The body has an access port formed in the center portion thereof and an internal pouch which extends substantially traversely over the inside of the body. A plurality of small objects are retained within the pouch, and a closure device is affixed to the access port for sealably retaining items contained within the pouch. In use, the expansible object may serve as a plaything, as an educational tool, as a storage device, or as a fashion accessory for retaining various items which are used in day-to-day living. The object, also, may include an illumination system for illuminating the interior thereof.

15 Claims, 10 Drawing Figures

FIG-8
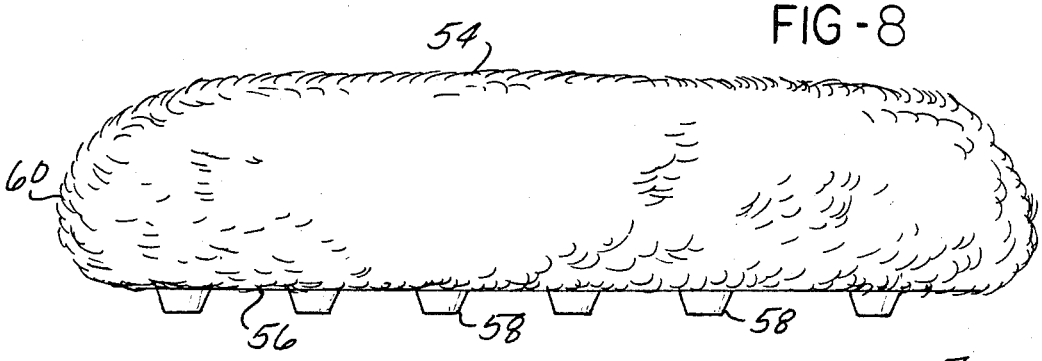
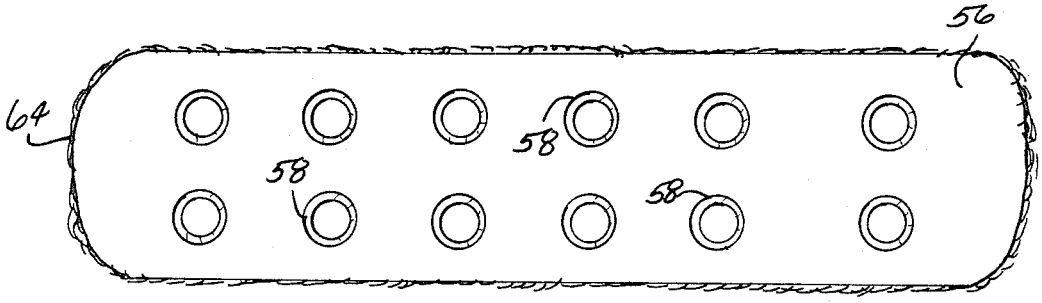
FIG-9
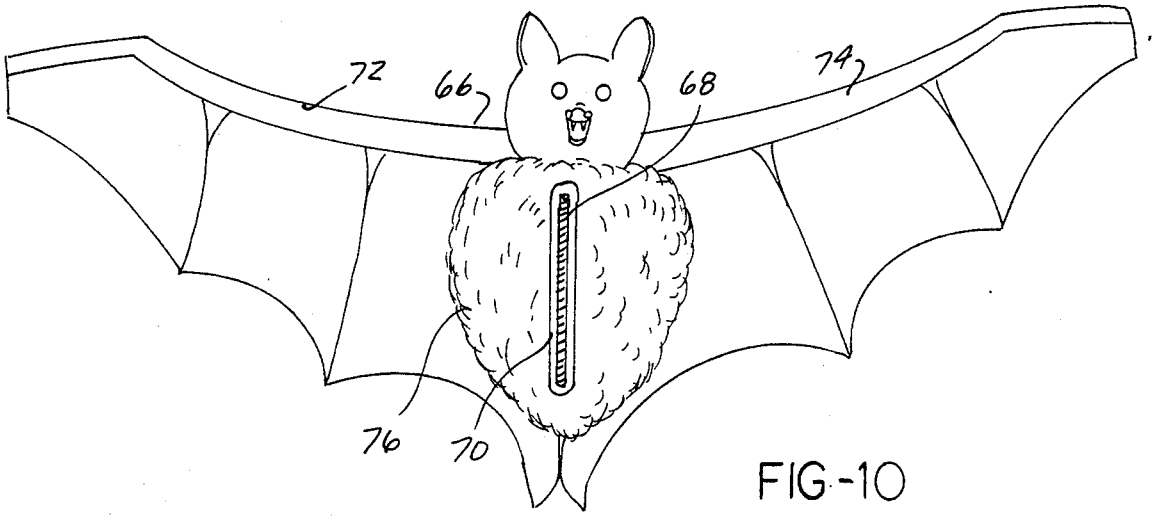
FIG-10

EXPANSIBLE OBJECT

BACKGROUND OF THE INVENTION

1. Field of the Invention

This invention relates generally to toys or playthings, and particularly concerns an expansible toy, having a body simulating in shape an animate object.

2. Description of the Prior Art

The current interest in inanimate play things and fashion accessories has led to a plethora of offerings which are available in the marketplace. Likewise, the prior art has taught expansible objects useful as playthings and/or storage devices.

The prior art includes, for example, U.S. Pat. No. 2,995,865, which was issued to Kiscadden. U.S. Pat. No. 2,995,865 discloses a doll having a mount with a slide fastener closure, in which the teeth are simulated by a zipper. The doll is unsuitable for use as a practical storage device however, since the mouth, and the oral cavity bounded by the teeth, are not large enough to accommodate more than a few small objects.

As a storage device, or fashion accessory, an expansible object is of interest to children and to young adults, who may use the object as a receptacle for various items used in day-to-day living.

As is subsequently detailed, the present invention is directed to overcoming one or more of the problems as set forth above by providing a new type of expansible object which offers the flexibility of use as a plaything or as a fashion accessory or storage device.

SUMMARY OF THE INVENTION

In one aspect of the present invention, an expansible object is disclosed, the expansible object comprising a body simulating, in shape, an animate object, such as an insect. The body has a head, and a center portion which is expansible. The body also has an access port formed in the center portion thereof, and an internal pouch formed therewithin which extends substantially over the width and length of the inside of the body. A means for closing is affixed to the access port, thus sealably retaining items contained within the pouch. In accordance with more specific aspects of the invention, the means for closing may comprise a VELCRO fastener, or a zipper.

In accordance with the broader aspects of the invention, the expansible object is highly advantageous, in that it may serve as a plaything. As a plaything, the expansible object houses within its pouch a plurality of small objects, each simulating, for example, a smaller form of the body.

The expansible toy, thus, provides a plaything for children, simulating a novel and attractive means for retaining small objects which may resemble young forms of the expansible object. The device also may serve as a fashionable, yet functional accessory or storage device, which serves as a receptacle for various items needed for use in day-to-day living.

BRIEF DESCRIPTION OF THE DRAWINGS

The various features, advantages, and other features of the present invention will become more apparent by referring to the following detailed description and drawing, in which like reference numbers refer to like parts throughout:

FIG. 8 is a side view of the expansible object, illustrating a fourth embodiment of the invention;

FIG. 9 is a bottom view of the expansible object, incorporating a fourth embodiment of the invention; and FIG. 10 is an illustration of the expansible object, incorporating a fifth embodiment of the invention.

DESCRIPTION OF THE PREFERRED EMBODIMENTS

Figure 1:
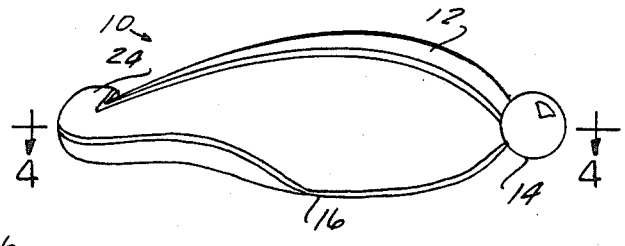
FIG. 1 is a side view of the expansible object, incorporating a first embodiment of the invention.
Figure 2:
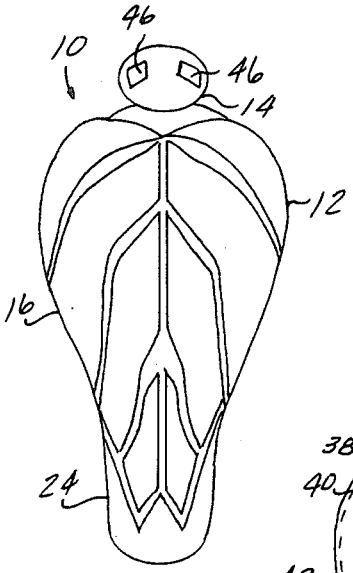
FIG. 2 is a top view of the expansible object, incorporating a first embodiment of the invention.
Figure 3:
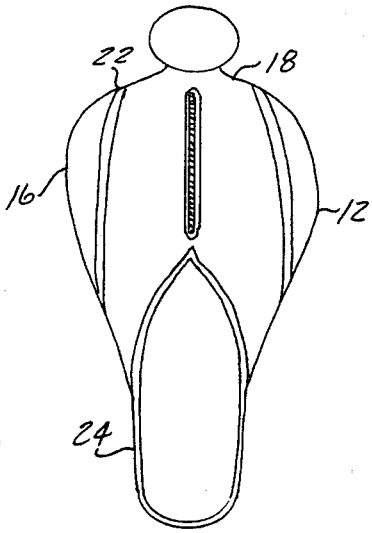
FIG. 3 is a bottom view of the expansible object, incorporating a first embodiment of the invention.

Referring now to the drawing, and in particular to FIGS. 1–3 thereof, there is shown an expansible object 10, incorporating a first embodiment of the invention. The expansible object 10 comprises a body 12 which simulates, in shape, an animate object, such as an insect. Examples of the species include a firefly, a bat, or a ladybug. At the outset, it is to be understood that, as contemplated herein, the expansible object 10 can assume any form, as desired. Thus, the insect forms depicted in the drawings are to be construed as illustrative, rather than limitative of the present invention. However, as will subsequently be detailed, in preferred forms of the present invention, a firefly, a bat, or a ladybug are desirable configurations. Again, it is to be understood that in the practice of the present invention, the expansible object 10 comprises an inanimate form, configured to any desired shape.

The body 12 includes a head portion 14 and an expansible center portion 16. The body 12 has an access port 18, which is formed on the bottom in the center portion 16 thereof, which allows access to an internal pouch 20, as best shown in FIG. 3, which extends substantially transversely across the inside of the body 12. The pouch 20 may accommodate small forms of the same shape of the object 10, or items needed for use in day-to-day living, or an electrical circuit, as to be described later herein. Means for closing 22, such as, a VELCRO fastener or a zipper are affixed to the access port 18 for sealably retaining items contained within the pouch 20.

As best shown in FIG. 3, the access port 18 and means for fastening 22 lie generally across the central portion 16 of the body 12, terminating above a tail 24 or similar terminus.

Figure 4:
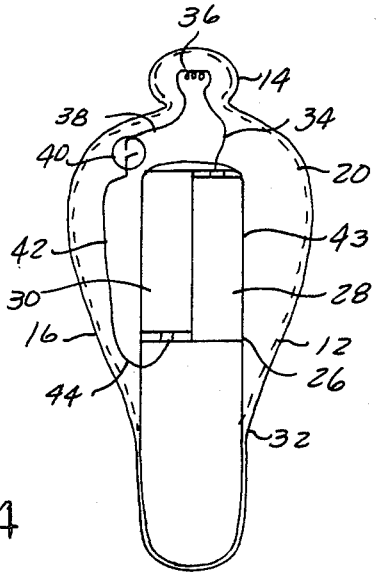
FIG. 4 is a sectional view of the expansible object, incorporating a second embodiment of the invention, taken along the line 4—4 in FIG. 1.

FIG. 4 illustrates a second embodiment of the invention, which is the same as the first embodiment, except for the presence of a source of iternal illumination. In the second embodiment, the body 12 has a container 26 disposed therewithin for receiving a source of electrical power, such as a plurality of batteries 28 and 30. The container 26 is affixed by conventional means, such as by sewing or gluing the inside of the pouch 20, proximate an inward extension of the terminus 24, located toward the rearward end 32 of the central portion 16.

The second embodiment, also, includes means for illuminating the inside of the head 14 in electrical communication with the source of power, The means for illuminating includes a first electrical conduit 34, connected to the battery 28. The first electrical conduit 34 delivers electric current from the first battery 28 to a light bulb 36 or other source of illumination. The light bulb 36 illuminates the inside of the body 12 proximate the head 14, and is affixed by conventional methods, such as gluing or sewing to the inside of the pouch 20, proximate the head 14.

A second electrical conduit 38 connects the light bulb 36 to a means for switching 40, which is linked to, and is closed by depression of either trigger 42 or 43. A third electrical conduit 44 connects the switch 40 the second battery 30.

As shown in FIG. 4, at least one opening 46 formed within the body 12, preferably, proximate the head 14, permits visual observation of the illumination. The head 14 has translucent eyes 46, defined by the openings, which transmit light from the light bulb 36 when the electrical circuit is completed by depression of either trigger 42 or 43. Either trigger 42 or 43 is activated by squeezing the outside of the body 12. The soft, collapsible consistency of the expansible object 10 readily allows the transmission of pressure from the hand to either trigger 42 or 43 by squeezing the outside of the body 12 around the center 16.

Figure 5:
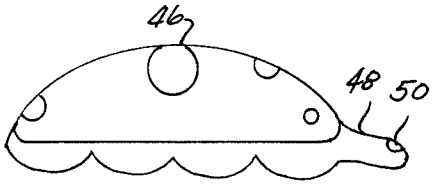
FIG. 5 is a side view of the expansible object, incorporating a third embodiment of the invention.
Figure 6:
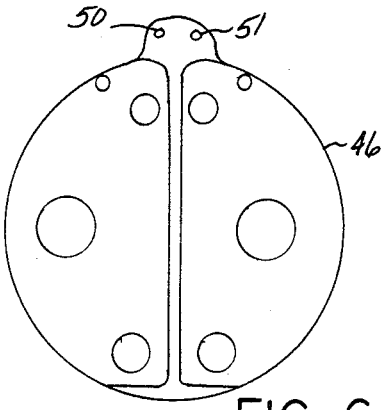
FIG. 6 is a top view of the expansible object, incorporating a third embodiment of the invention.
Figure 7:
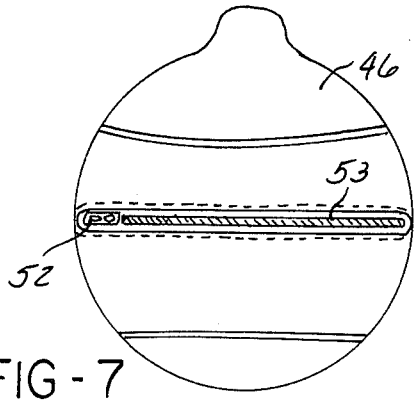
FIG. 7 is a bottom view of the expansible object, incorporating a third embodiment of the invention.

FIGS. 5–7 illustrate a third embodiment of the invention, which is similar to the first and second embodiments, except that its form simulates, in shape, another animate object, such as a ladybug, and which defines a toy. As shown in FIGS. 5–6 the body 46 includes a head 48, eyes 50 and 51, and is generally circular in horizontal cross-section.

As access port 52 lies generally transversely across the body 46. The access port 52, in the embodiment shown in FIG. 7, includes a conventional means for closing, such as a zipper 53. A pouch (not shown) is formed within the body 46. Access port 52, when opened, permits access to the pouch. A plurality of small objects 47, each simulating a smaller form of the body 46, are removable stored in the pouch. Other types of contents are, of course, possible without departing from the scope of the present invention.

FIGS. 8–9 illustrate a fourth embodiment of the invention, which is similar to the third embodiment, except that its shape is generally oviform. As best shown in FIG. 8, the upper surface 54 is comprised of a fur-like material, thus affording a warm and endearing appearance. The upper surface 54 is also generally oval in shape. The upper surface 54 is gathered to define a side wall 60, which extends downwardly to a substantially oval periphery 62, which is fixed to the periphery 64 of the bottom surface 56. The upper surface 54 has an access port formed therein, and means for closing the access port, such as a VELCRO fastener or a zipper. This permits access into the interior from the top of the device. As best shown in FIG. 9, the bottom surface 56 is generally oval in shape, and is formed of a rubber-like material, which thus affords durability and pliability to the expansible object 10. The bottom surface 56 has a plurality of frusto-conical protrusions 58 extending downwardly therefrom, thus provided a skid-free bottom 56 to the expansible object 10.

Referring to FIG. 10 in which is depicted still another embodiment hereof, the object 10 is shown as a bat having an opening or port 68 provided access into the interior, which is sealable via a VELCRO band 70 or similar closure. In accordance herewith the object 10 has a simulated pair of opposed wings 72, 74. The wings 72, 74 are secured to the body 76 by any convenient method. The wings 72, 74 are, preferably, formed from a deformable plastic or rubber-like memoried material which enables the wings to be bent to any desired configuration. The memoried materials are well known and commercially available.

It will thus be understood that the present invention comprises an expansible object which houses a plurality of smaller objects, such as smaller forms of the body, or stores other objects.

having thus described in the invention, what is claimed is:

1. An expansible object comprising:

a body, simulating an animate object, the body having an access port communicating with an internal pouch, the internal pouch extending substantially over the width and length of the inside of the body;

a plurality of small objects, each simulating a smaller form of the body, storable within the internal pouch of the body; and means for closing the access port to retain the plurality of small objects within the internal pouch.

2. The expansible object of claim 1, wherein the means for closing comprises a VELCRO closure.

3. The expansible object of claim 1, wherein the means for closing comprises a zipper.

4. The expansible object of claim 1, wherein the body is in a form selected from a group consisting of a firefly, a ladybug, a caterpillar, and a bat.

5. The expansible object of claim 1, wherein the body further comprises:

a generally oval rubber-like bottom surface more than four frusto-conical protrusions extending downwardly therefrom; and a generally oval fur-like upper surface extending downwardly to define a sidewall fixed to the periphery of the generally oval rubber-like bottom surface.

6. The expansible object of claim 1, further comprising:

a source of electrical power:

a container for receiving the source of electrical power secured to the inside of the internal pouch;

a source of illumination housed within the body;

means for conducting electrical power from the source of electrical power to the source of illumination;

internal means for switching, responsive to squeezing the body, to energize the source of illumination; and a translucent part of the body for externally transmitting light from the source of illumination housed within the body when energized.

7. The expansible object of claim 6, wherein the means for closing comprises a VELCRO closure.

8. The expansible object of claim 6, wherein the means for closing comprises a zipper.

9. An expansible object comprising:

a body, simulating an animate object, the body having an access port communicating with an internal pouch, the internal pouch expanding substantially over the length and width of the body;

means for closing the access port;

a source of electrical power;

a container for receiving the source of electrical power secured to the inside of the internal pouch;

a source of illumination housed with the body;

means for conducting electrical power from the source of electrical power to the source of illumination;

internal means for switching, responsive to squeezing the body, to energize the source of illumination; and a translucent part of the body for transmitting light from the source of illumination when energized.

10. The expansible object of claim 9, wherein the means for closing comprises a velcro closure.

11. The expansible object of claim 9, wherein the means for closing comprises a zipper.

12. The expansible object of claim 9, wherein the body is in a form selected from a group consisting of a firefly, a ladybug, a catapillar, and a bat.

13. The expansible object of claim 9, further comprising a plurality of small objects, each simulating a smaller form of the body, storable within the internal pouch of the body.

14. The expansible object of claim 11, wherein the body further comprises:

a generally oval rubber-like bottom surface having more than four frustro-conical protrusions extending downwardly therefrom; and a generally oval fur-like upper surface extending downwardly to define a sidewall fixed to the periphery of the generally oval rubber-like bottom surface.

15. An expansible object comprising:

a body, simulating in shape an animate object, the body having an access port communicating with an internal ouch, the internal pouch extending substantially over the width and length of the inside of the body;

a plurality of small objects, each simulating a smaller form of the body, storable within the internal pouch;

means for closing the access port to retain the plurality of small objects within the internal pouch;

a source of electrical power;

a container for receiving the source of electrical power, the container secured to the inside of the internal pouch;

a source of illumination housed within the body;

means for conducting electrical power from the source of electrical power to the source of illumination;

internal means for switching, responsive to external squeezing of the body, to energize the source of illumination; and a translucent part of the body for externally transmitting light from the source of illumination housed within the body when energized.

* * * * *